United States Patent [19]

Chaudot et al.

[11] 4,310,296

[45] Jan. 12, 1982

[54] HEAT-SHIELD FOR GAS-BURNING FLARE IN OIL PRODUCTION INSTALLATIONS, PARTICULARLY PLATFORMS AT SEA

[75] Inventors: Gérard Chaudot, Andresy; René Ombret, Pau; Paul Zimmerman, Nanterre, all of France

[73] Assignee: Societe Nationale Elf Aquitaine, Courbevoie, France

[21] Appl. No.: 12,432

[22] Filed: Feb. 15, 1979

[30] Foreign Application Priority Data

Feb. 15, 1978 [FR] France ..... 78 04225

[51] Int. Cl.[3] ..... F23D 13/20; F23D 13/36

[52] U.S. Cl. ..... 431/5; 431/202; 431/346

[58] Field of Search ..... 431/5, 202, 346; 181/205, 210, 223

[56] References Cited

U.S. PATENT DOCUMENTS

| | | | |
|---|---|---|---|
| 2,204,170 | 6/1940 | Zwilling | 239/214.11 |
| 2,537,091 | 1/1951 | Rodman et al. | 431/202 X |
| 2,802,521 | 8/1957 | Campbell et al. | 431/202 X |
| 3,528,336 | 9/1970 | Douner | 181/223 X |
| 3,602,299 | 8/1971 | Mozic | 431/202 X |
| 3,807,940 | 4/1974 | Juricek | 431/202 X |

FOREIGN PATENT DOCUMENTS

| | | | |
|---|---|---|---|
| 2357759 | 5/1974 | Fed. Rep. of Germany | 431/202 |

*Primary Examiner*—Robert S. Ward, Jr.

*Attorney, Agent, or Firm*—Burgess, Ryan and Wayne

[57] ABSTRACT

A process to protect oil production installations from heat radiation given off by the flame of a gas-burning flare. In said process, a heat-shield is installed a short distance below the flare nozzle, to protect installations from at least part of the heat radiated by the flare flame.

5 Claims, 5 Drawing Figures

HEAT-SHIELD FOR GAS-BURNING FLARE IN OIL PRODUCTION INSTALLATIONS, PARTICULARLY PLATFORMS AT SEA

This invention concerns a process to protect oil production installations from heat radiation given off by the flame of a gas-burning flare; it also concerns a heat-shield for a flare in such an installation particularly on a platform at sea.

Production of liquid hydrocarbons involves large quantities of gas, which must be removed or eliminated.

Flares also need to be provided on gas production fields, for safety during operations.

Various techniques have already been put forward and used to eliminate this gas.

The gas is usually burned at the outlet of a flare located some distance from the actual installations, and connected to them by pipeline.

At sea, this arrangement obviously means that the flare outlet has to be located far enough from the installation to ensure that normal operations are not interfered with by the large amount of heat radiation that always accompanies combustion of gas.

One suggestion has been to position the gas-burning flare actually on the platform, but suspended beyond it. For structural and economic reasons, the distance between platform and burner nozzle is usually confined to about fifty meters, so that the amounts of gas that can be eliminated are correspondingly restricted.

Surplus gas is sometimes simply released into the atmosphere through a cold outlet; however, it is always subject to accidental ignition, so that the platform still needs to be protected against the heat radiation that would result.

The purpose of this invention is to reduce the effect of heat radiation given off by the flare flame, particularly on sensitive parts of the installation, while allowing the flare to be installed on the platform itself.

This invention concerns a process to protect oil production installations from heat radiation given off by the flame of a gasburning flare, in which the gas is ejected at a high enough velocity to ensure that a major portion of the flame beyond the flare nozzle remains vertical, regardless of wind-speed, and in which at least part of the heat radiated directly towards the platform is shielded. The platform is therefore shielded from the direct radiation which the straight portion of the flame would otherwise give off in the direction of the platform.

In one embodiment of this process, radiation is blocked by installing a heat-shield a short distance below the flare nozzle.

In another embodiment of the process, the gas is ejected at a velocity of more than 0.2 Mach.

In general, the flare nozzle is specifically designed to ensure a sufficiently high ejection velocity.

In preferred embodiments, the heat-shield consists of at least one circular disc or conical structure on the same axis as the flare pipe. In another embodiment, this heat-shield consists of a number of concentric flat rings or truncatedconical structures.

This invention also concerns a heat-shield for application of this new process, comprising an approximately horizontal screen with a reflecting top surface, surrounding a tall vertical flare pipe, the upper part of which forms the flare nozzle.

In one embodiment, the flare pipe is supported along part of its height by the drilling rig, which is surmounted by a structure forming a support for a framework to support the heat-shield.

In another embodiment, the heat-shield is constructed from stainless-steel plating, polished on top and supported on the framework by means of banded elastomer blocks designed to permit the plating to expand freely and to insulate it from the framework and supporting structure.

Consequently, as will be described in detail below, the heat-shield intercepts most of the heat radiation given off by the burning gas, which would otherwise raise the temperature of the surface of the installation at the base of the flare, preventing normal operations from taking place.

It will be easier to understand the features of the invention from the following description, given solely as an example, with reference to the accompanying drawings.

Figure 1:
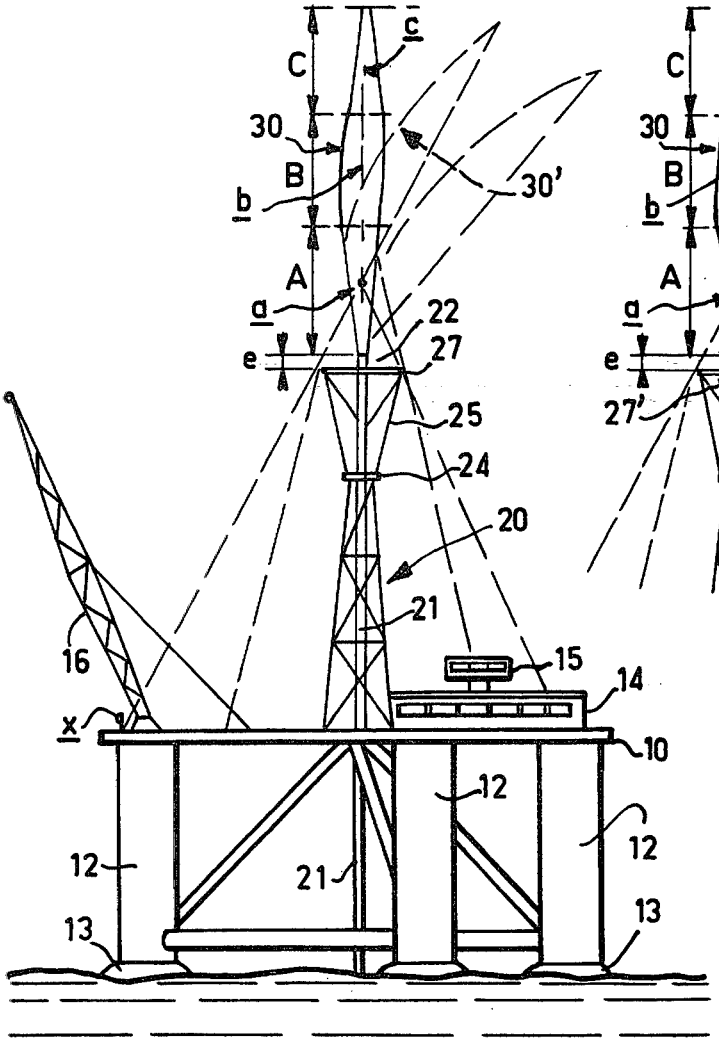
FIG. 1 is a diagrammatical view in elevation of a platform equipped with a gas-burning flare fitted with this new heat-shield.
Figure 2:
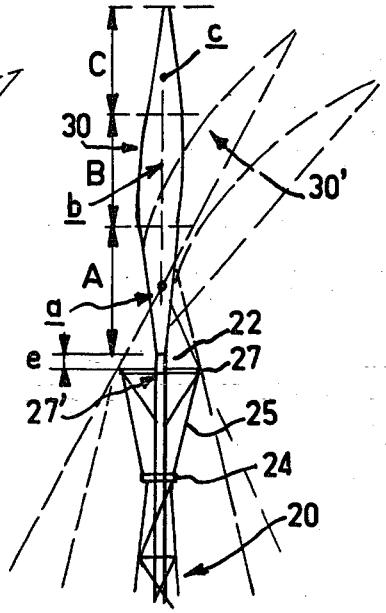
FIG. 2 is a cross-section of a heat-shield in the form of a single circular ring.

FIG. 1 provides a diagrammatical view of a drilling and processing installation, comprising a platform 10, supported by a number of columns 12 connected together for strength and each resting on a caisson 13.

The platform carries a processing plant 14 and various installations 15 and 16, as well as a drilling rig 20, constructed in the usual way from steel sections, in the general overall shape of truncated pyramid very elongated in height. This rig normally rises about 50 m above the floor of the platform, which may cover an area within a 50 m radius.

For this invention, the drilling and treatment plant is equipped with a vertical flare pipe 21, running from the processing installations along the drilling rig, against which it is held, and ending in a nozzle 22 which is 60 m above the platform floor.

A structure 25, consisting of tubular and angular sections, attached to the upper end 24 of the rig, supports the flare nozzle.

This structure 25 also supports a heat-shield 27, consisting of an approximately horizontal screen surrounding the pipe 21 and located a short distance e below the flare nozzle 22; e is approximately 1.5 m.

Gas resulting from production processes is dispatched along the pipe 21 and ignited at the nozzle, producing a flame 30, approximately 55 m high in this example.

Energy given off towards the platform by this flame 30 is partly intercepted by the heat-shield, which may be in the form of a circular disc coaxial to the flare pipe, approximately 15 m in diameter. To ensure greater effectiveness, the top surface of the heat-shield should be reflecting.

To make it easier for the air below the heat-shield to reach the flame and to prevent the disturbances that would otherwise be caused by air-streams skirting round the disc 27, the heat-shield is designed in the form of an annular element, as shown in elevation e.g. in FIG. 3. The screen 27 contains a circular opening 27', the diameter of which may range from 2 to 6 times the diameter of the flare pipe 21.

Figure 3:
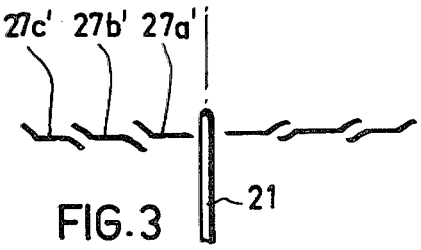
FIG. 3 is a cross-section of a heat-shield in the form of a number of flat concentric circular rings.
Figure 4:
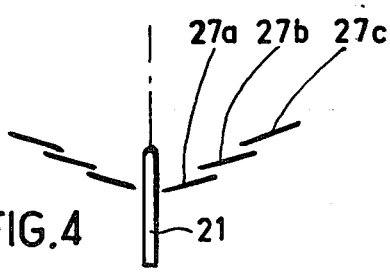
FIG. 4 is a cross-section of a heat-shield in the form of a number of truncated-conical concentric circular rings.

FIGS. 3 and 4 each show a cross-section of a heat-shield consisting of a number of concentric rings 27*a*, 27*b* and 27*c*. Moving away from the flare pipe, the outside diameter of each of these rings is at least equal to the inside diameter of the following ring, and the edges of adjacent rings are kept apart.

In FIG. 3, the shield consists of flat rings 27*a'*, 27*b'*, 27*c'*, the inner and outer edges of which are bent in a substantially S-shaped manner, so that the edges of adjacent rings are not in contact.

In FIG. 4, the shield consists of truncated conical rings, and the edges of adjacent rings are kept apart by positioning the ring surfaces at different respective levels along the centerline of the flare pipe.

The embodiments shown in FIGS. 3 or 4 allow air to pass through the shield in an upward direction, which both cools the shield and supplies the base of the flame with air for combustion.

In one embodiment, the heat-shield 27 consists of stainless-steel sheet elements with a polished upper surface, supported on the framework 25 by means of ferruled or iron banded elastomer blocks which permit the sheet elements to expand freely, and insulate it from the framework.

If no wind is blowing over the platform, the flame 30 remains vertical, as shown in FIG. 1. In this case, the central part of the platform is protected against any heat radiation given off by the flame, and it is only at a certain distance D from the center of the platform that the floor is subject to radiation, the approximate value of which is shown in the chart in FIG. 5 by the continuous line, in relation to D, expressed in BTU/Sqf/hr and corresponding to a gas flow-rate of $1.8375\times10^6$ SCF/hr (i.e. $1.15\times10$ $Nm^3$/day), the flare nozzle being so designed that the gas is ejected at a velocity of 0.3 Mach.

If a wind of 57 m/sec (i.e. approximately 200 km/hr) is blowing, the top of the flame 30 bends under its force, taking up position 30' at an angle of approximately 33° to the vertical, while the lower part of the flame remains almost vertical. The screen then no longer intercepts all of the heat radiation given off by the flame in the direction of the central part of the platform. If the wind velocity is 45 m/sec (162 km/hr), the flame 30 bends at an angle of 27° to the vertical.

Figure 5:
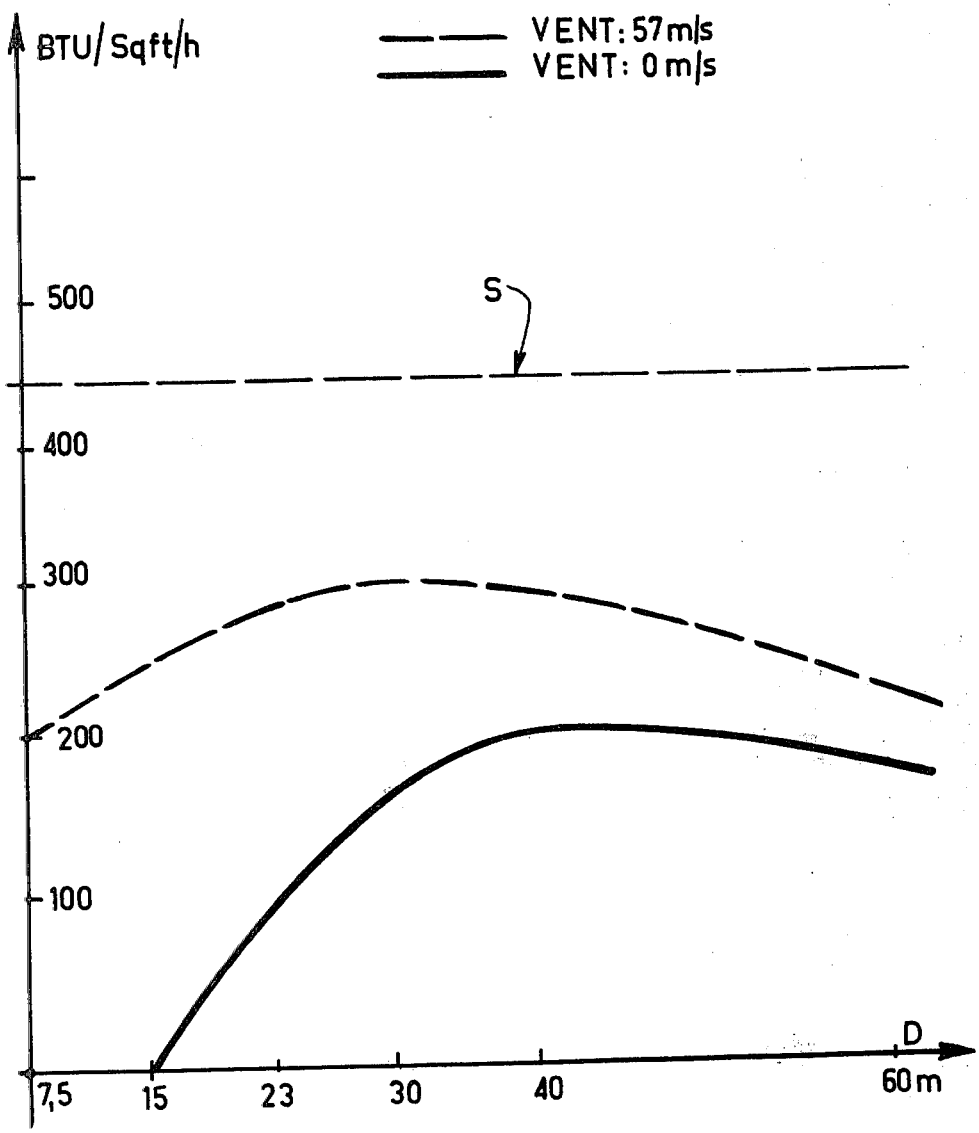
FIG. 5 is a guidance chart, showing some levels of radiations given off by the flare flame, level with the platform flooring, in relation to the distance from the base of the flare, for some local wind velocities.

The broken line on the chart in FIG. 5 shows distribution of heat radiation reaching the platform in the case of a wind velocity of 57 m/sec.

Although radiation in this case is higher, it is still below an upper limit S below which exposed parts of the platform may be used normally. Depending on the function of the exposed area, this limit S ranges from 440 to 2,000 BTU/H/Sqf (i.e. from 1195.4 to 5424.6 kcal/H/$m^2$).

For information, it should be remembered that the calorific effect is proportional to the inverse square of the distance between the point of emission in the flame and the point on the platform receiving radiation.

In fact, it is the parts of the flame closest to the flare nozzle that have the greatest effect, and this is precisely where the heat-shield is most effective.

The closer the shield is to the flare nozzle, the more radiation it will block; however, for technological reasons, involving expansion and strength of materials, experience shows that a distance of 1 to 3 meters, and preferably 1.5 meters, is both acceptable and effective.

Similarly, the diameter of the shield, which is approximately 15 m in the example described here, may vary depending on the length of flame and composition of gas.

For all these reasons, values and figures quoted above are given purely for guidance, and may be altered depending on specific operating variables.

The heat-shield may consist of a single sheet or of component parts assembled by any appropriate method.

Naturally, this invention is in no way confined to the embodiments described and illustrated here: many variations are possible for someone skilled in the art, depending on what applications are involved and without any departure from the spirit of the invention.

What is claimed is:

1. A process of protecting at least a selected portion of the area of an oil production installation from the heat radiation emitted by the generally upwardly extending flame produced at the outlet of the nozzle of a gas burning flare mounted on the top end of a generally vertical flare pipe extending from a platform supporting said installation, said selected area portion being defined about the geometrical axis of said flare pipe, comprising the steps of:

ejecting said gas to be burned through said nozzle at a flow velocity higher than Mach 0.2 and shielding said selected area portion from said heat radiation by providing, at a distance of 1 to 3 meters below said nozzle outlet, substantially horizontal annular heat shielding means made of stainless steel sheet and means having an outer periphery and an inner periphery which delimits a central circular aperture the diameter of which equals about2 to 6 times the diameter of said flare pipe, said inner periphery concentrically surrounding said flare pipe.

2. The process of claim 1, wherein said heat shielding means comprises a single annular heat shielding element.

3. The process of claim 1, wherein said heat shielding means comprises a plurality of concentric annular heat shielding elements, and an annular cooling air passage is provided between any two adjacent ones of said concentric elements.

4. The process of claim 1, wherein said heat shielding means comprises a plurality of concentric frusto-conical annular heat shielding elements each having an outside diameter at least equal to the inside diameter of an adjacent shielding element, said shielding element being disposed in such a manner that an annular cooling air passage is defined between any two adjacent shielding elements.

5. The process of claim 1, wherein said heat shielding means comprises a plurality of concentric annular heat shielding elements each having a substantially S-shaped profile and an outside diameter at least equal to the outside diameter of an adjacent shielding element, said shielding elements being disposed in such a manner that an annular cooling air passage is defined between any two adjacent shielding elements.

* * * * *